United States Patent [19]

Ferriter

[11] 4,015,767

[45] Apr. 5, 1977

[54] CONTAINER

[75] Inventor: Roger G. Ferriter, Yonkers, N.Y.

[73] Assignee: Wix Corporation, Gastonia, N.C.

[22] Filed: May 5, 1976

[21] Appl. No.: 683,634

[52] U.S. Cl. ..... 229/16 R; 229/41 C

[51] Int. Cl.[2] ..... B65D 5/06

[58] Field of Search ..... 229/41 C, 16 R

[56] References Cited

UNITED STATES PATENTS

| | | | |
|---|---|---|---|
| 2,174,687 | 10/1939 | Comley | 229/16 R |
| 2,319,974 | 5/1943 | Buttery | 229/41 C |
| 2,320,665 | 6/1943 | Shearer | 229/16 R |
| 2,372,312 | 3/1945 | Buttery | 229/16 R |
| 2,707,586 | 5/1955 | Buttery | 229/41 C X |
| 2,925,213 | 2/1960 | Zukoski | 229/41 C |

*Primary Examiner*—Davis T. Moorhead
*Attorney, Agent, or Firm*—Shoemaker and Mattare, Ltd.

[57] ABSTRACT

An integral foldable container-forming blank, a container formed therefrom. The container has the shape of an irregular heptagon with two wall panels each being longer than the other wall panels. The "long" wall panels are reinforced by flaps foldably attached to other wall panels and can each serve as a base for supporting the container.

15 Claims, 6 Drawing Figures

CONTAINER

BACKGROUND OF THE INVENTION

The present invention relates to containers and, more particularly, to containers formed from integral foldable blanks. Most specifically, the invention relates to a container for automobile air filters. The invention also relates to a method of forming such containers.

The main object of the present invention is to provide a container which will coact with a display structure.

Another object of the present invention is to provide a container which can be stored in a variety of stable orientations.

A further object of the present invention is to provide a container which has reinforced side walls.

SUMMARY OF THE INVENTION

A container made in accordance with the teachings of the present invention is easily set-up and stacked in a variety of stable orientations. Specifically, a container formed in accordance with the present invention can be supported in a particular orientation to coact with a display structure specifically designed therefor.

The container is formed from an integral blank of foldable material which comprises a plurality of rectangular wall forming panels, hereafter referred to as wall panels, a first one of which has its two side edges each defining a side edge of one of a pair of heptagonal end forming panels, hereafter referred to as end panels, and its two end edges each defining an end edge of a pair of wall panels. Except for those edges defined by the edges of the blank, all edges are defined by areas of increased flexibility which form foldlines about which the elements are hinged to form a container from the blank.

A first end panel of the two end panels has other edges thereof each defining one side edge of each of a plurality of elongated tongues, and one edge which defines a side edge of an elongated adhesive receiving flange. Each wall panel has at least one locking tab section flexibly attached to one side edge thereof, and the tongues each also have a locking tab receiving aperture defined therein for receiving those locking tabs to close the container.

A plurality of rectangular wall panels each has one side edge thereof defined by a side edge of the second end panel of the two end panels, and one wall panel of the plurality of wall panels has one end edge thereof defining an end edge of another rectangular wall panel. A pair of adjacent wall panels each has a length which exceeds the length of other wall panels and are oriented with respect to each other to form a right angled corner upon set-up of the container. A plurality of rectangular flaps each has one end edge thereof defined by one edge of a corresponding wall panel about which the flaps are foldable to form the container.

Set-up of the container from the blank is easily and quickly accomplished by moving the end panels into substantial parallelism with each other by folding the end panels about the first wall panel, then folding appropriate tongues into an upright position with respect to the corresponding end panel, and setting up some of the wall panels by locking appropriate locking tabs into corresponding locking tab receiving apertures in the folded tongues. The adhesive receiving flange can be secured to one of the wall panels, and the container formation continued by folding flaps into positions whereat they will act as reinforcing supports for the corresponding wall panels of the container. The container is completed by folding the remaining tongues into positions over the flaps, and securing the remaining wall panels to those tongues by locking appropriate locking tabs into corresponding locking tab receiving apertures.

Two adjacent wall panels of the formed container are each longer than the other wall panels, and both are foldably and hingeably attached to the second end panel. The two wall panels are each at essentially right angles with respect to each other. One of these two "long " wall panels is secured to the other end panel by being adhesively attached to the adhesive receiving flange, and the other "long" wall panel has two locking tabs thereon for locking that wall panel to the first end panel and has a pair of flaps located adjacent thereto.

Thus, the two "long" wall panels are securely held in place in the formed container and form a 90° corner of that container. The container can thus be supported on either one of these two wall panels with the ends being in and essentially vertical orientation. Because these two wall panels are longer than the other wall panels, the container can be oriented in a variety of ways to conform with, and coact with, a display or storage structure. The reinforced wall panels also enable several containers to be stacked on top of each other without danger of crushing the containers and possibly damaging the contents thereof.

Furthermore, the "long" wall panels provide sufficient surface area so that a filled container is stable in the upright orientation.

Further advantages of a container formed in accordance with the present invention are: easy set-up; maximum utilization of blank forming stock; and the like.

These together with other objects and advantages which will become subsequent apparent reside in the details of construction and operation as more fully hereinafter described and claimed, reference being had to the accompanying drawings forming part hereof, wherein like numerals refer to like parts throughout.

DETAILED DESCRIPTION OF THE PREFERRED EMBODIMENT

Figure 1:
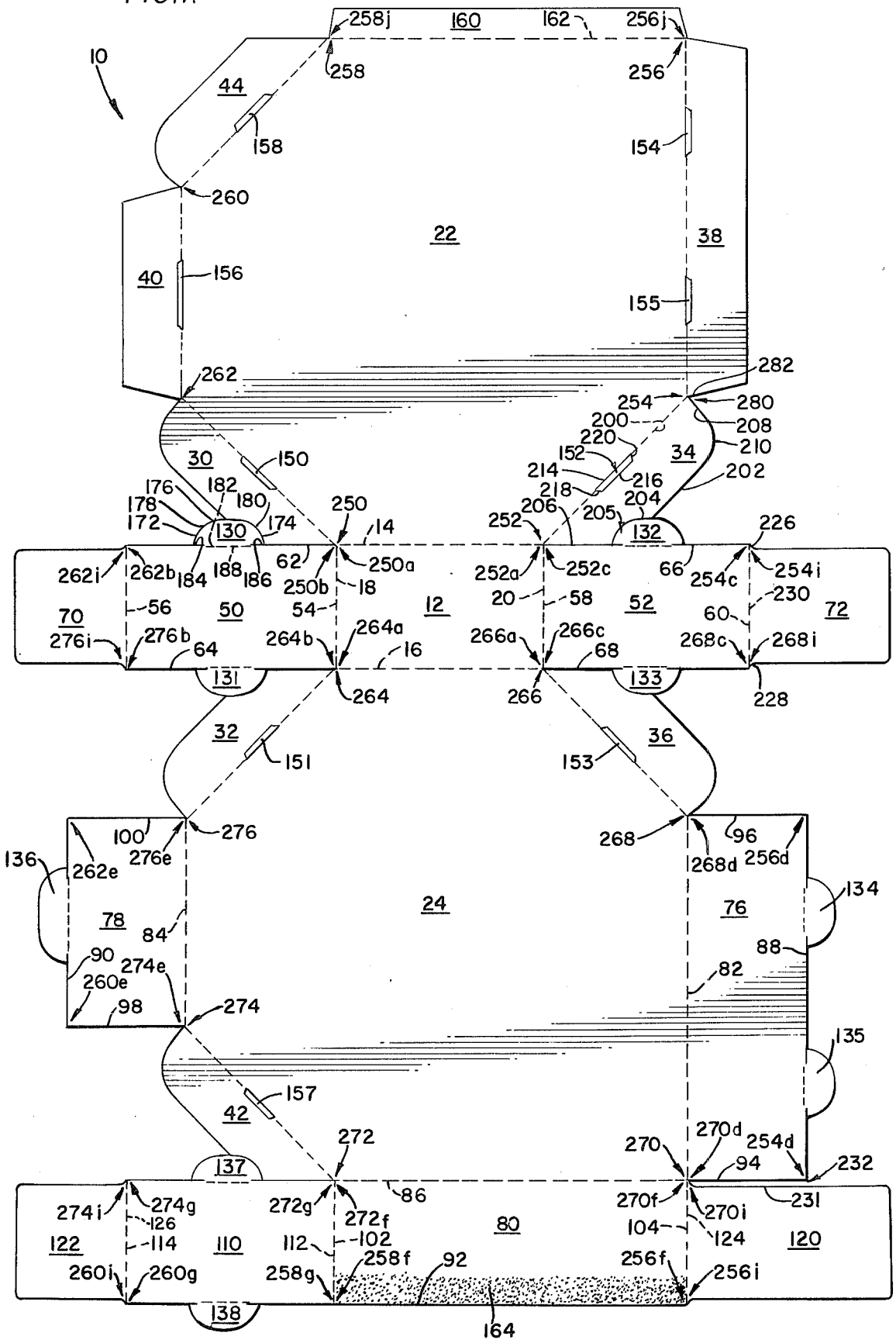
FIG. 1 is a plan view of an integral foldable container-forming blank in accordance with the teachings of the present invention.
Figure 2:
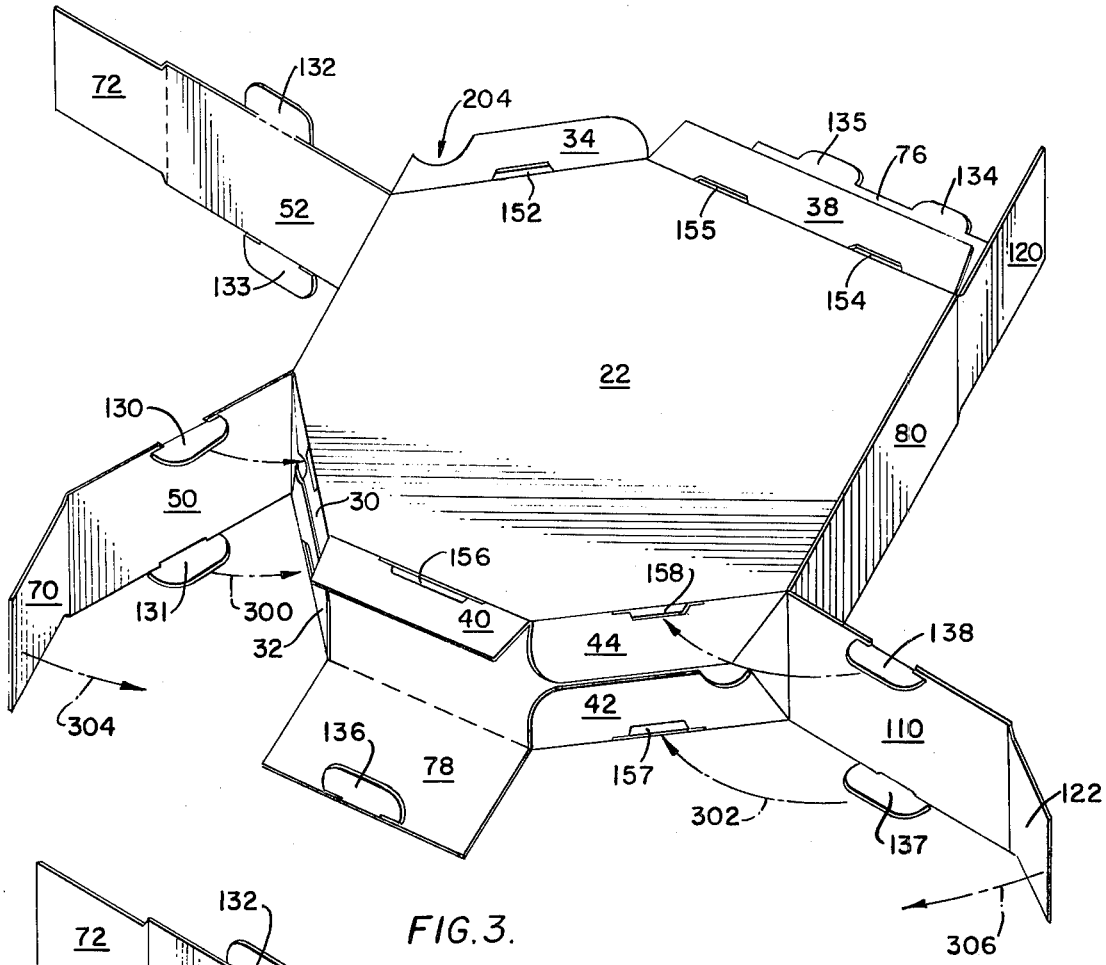
FIGS. 2, 3 and 4 are perspective views of a partially formed container in accordance with the teachings of the present invention.
Figure 3:
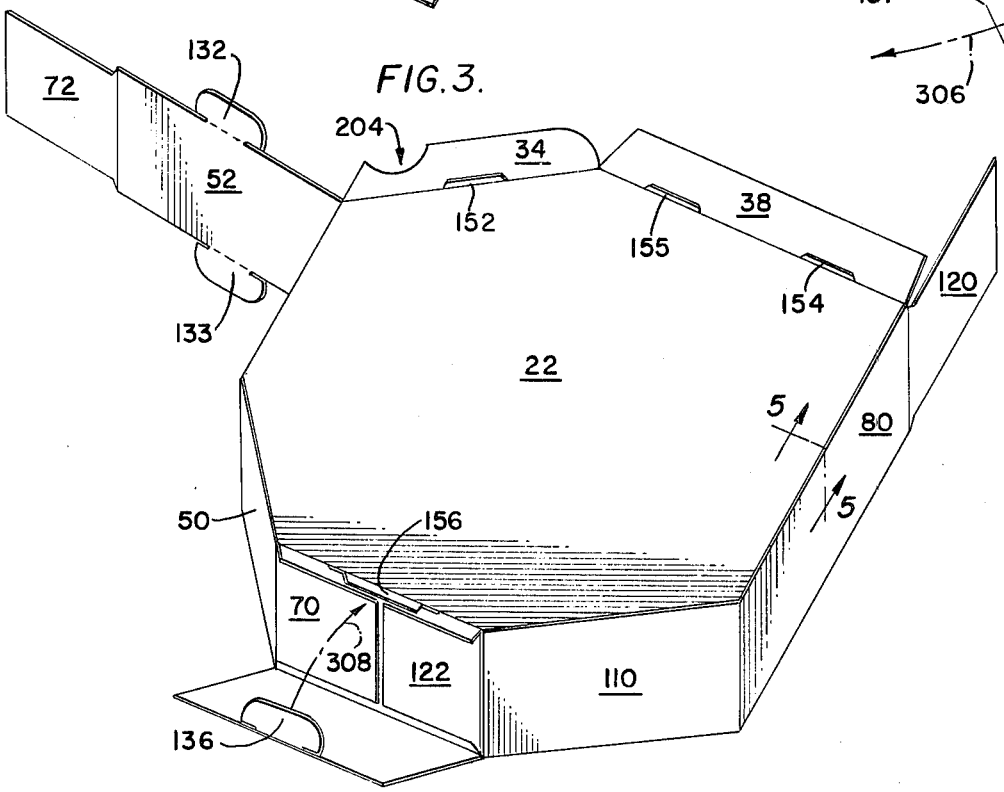

Shown in FIG. 1 is an integral blank 10 of foldable material such as paper, cardboard, or the like, which is used to form a container. In general, the blank 10 includes a first side wall forming panel, or wall panel 12 which is elongated and preferably rectangular and has side edges 14 and 16 and end edges 18 and 20 formed by areas of increased flexibility defining foldlines, and a pair of end forming panels, or end panels, such as first end panel 22 and second end panel 24, each being in the shape of an irregular polygon, preferably an irregular heptagon, with one side edge defined by one of the side edges of wall panel 12. A plurality of elongated, generally polygonal, tongues, such as tongues 30, 32, 34, 36, 38, 40, 42 and 44, each have one side edge thereof defined by a side edge of the first and second end panels. As shown in FIG. 1, the tongues 30, 34, 38, 40 and 44 are positioned on side edges of the first end panel, while the tongues 32, 36 and 42 are positioned on side edges of the second end panel. Second and third wall panels 50 and 52 are also rectangular and have end edges 54, 56, 58 and 60 and side edges 62, 64, 66 and 68, respectively, with end edges 54 and 58 being defined by foldlines which also define end edges 18 and 20 of the first end panel 12, and end edges 56 and 60 also being defined by foldlines which also define one end of each of a pair of polygonal flaps 70 and 72.

Fourth, fifth and sixth side walls are denoted by numerals 76, 78 and 80, and are also generally rectangular and have side edges 82, 84 and 86, respectively, each defined by a foldline which also defines one side edge of the polygonal second end panel 24, and each have opposite side edges 88, 90 and 92, respectively, and end edges 94, 96, 98, 100, 102 and 104, with end edges 102 and 104 of the sixth side wall section being defined by areas of increased flexibility forming foldlines. The wall panels 76 and 80 are adjacent each other and preferably have lengths greater than the lengths of the other wall panels. In the formed container, these wall panels will cooperate to form a pair of wall panels which are oriented to be substantially at right angles to each other. These wall panels will be discussed in greater detail below.

A seventh wall panel 110 is also rectangular and has an end edge 112 being defined by a foldline which also defines end edge 102 of the sixth wall panel 80, thus hingeably and flexibly connecting wall panels 80 and 110 together thereat. Seventh wall panel 110 also has an end edge 114 which is located opposite end edge 112 and which is also defined by a foldline. Flaps 120 and 122 are generally polygonal and elongated and have end edges 124 and 126 being defined by the foldlines which also define edges 104 and 114 respectively, thereby hingeably and flexibly interconnecting the flaps in the respective wall panels.

A plurality of locking tabs, identified as locking tabs 130 through 138, are each hingeably and flexibly joined to respective side edges of the wall panels, and are each located thereon to cooperate with corresponding locking tab receiving apertures 150 through 158 defined in the tongues 30 through 44.

A trapezoidal adhesive receiving flange 160 has one side edge 162 defined by a foldline which also defines one side edge of the first end panel 22. As shown in FIG. 1, adhesive, such as glue 164, is preferably placed on the inside (as referenced to a completed container) of sixth wall panel 80 adjacent the side edge 92 thereof to seal that panel to the outside (as referenced to a completed container) of the flange 160; however, adhesive can also be placed on the flange 160.

As shown in FIG. 1, the locking tabs are each generally shaped to form irregular trapezoids wherein the non-parallel side edges thereof are arcuate. For example, the locking tab 130 has non-parallel side edges 172 and 174 which are tangentially joined to one of the parallel side edges 176 at sections 178 and 180 while intersecting the other parallel side edge 182 at corners 184 and 186. The long side edge of the locking tabs, such as side edge 182 of locking tab 130, are partially defined by a foldline, such as foldline 188, which also defines a portion of a side edge of the corresponding wall panel, such as side edge 62 of the wall panel 50. The remainder of the locking tab long side edge is separated from the side edge of the wall panel adjacent thereto by a slit which removes little or no material from the blank 10 so the locking tab can be folded with respect to the wall panel without due interference between the two adjacent edges.

As shown in FIG. 1, the foldlines, such as foldlines 188, have finite widths so that they can be colinear with both the locking tab along a side edge, such as side edge 182, and with the wall panel side edge, such as side edge 62. All of the locking tabs are similar in shape, and are adapted to fit into the corresponding locking tab receiving apertures in a manner such that the arcuate edges, which form ears, slide easily through the aperture and lock the tab in place when the edge thereof formed by the long side edge thereof, such as edge 182, engages against the surface of the tongues, which surface is located on the side thereof opposite the wall panel.

It is also noted that locking tabs 134 and 135 are both located on the same side edge, i.e., side edge 88, of the wall panel 76, otherwise, these tabs are identical with the just-described locking tabs.

As shown in FIG. 1, with the exception of tongues 38, 40 and 44, all of the tongues are similar in outline and have two parallel side edges, such as side edges 200 and 202 of tongue 34. The side edge 200 is defined by a foldline which also defines one side edge of end panel 22, and side edge 202 has a notch 204 defined therein shaped to receive a portion of a locking tab, such as sector 205 of locking tab 132, which is positioned adjacent the tongue in the flattened FIG. 1 position. Two non-parallel end edges, such as end edges 206 and 208 of tongue 34, define end edges of the tongue with edge 206 being essentially straight, and intersecting notch 204, and end edge 208 intersecting side edge 200 and being joined to side edge 202 by an arcuate corner 210 which is tangentially joined to both end edge 208 and side edge 202.

The locking tab receiving apertures, such as locking tab receiving aperture 152, are generally trapezoidal in shape, with the long side edge of the parallel side edges, such as side edge 214 of locking tab aperture 152, defined in the side edge of the tongue, such as side edge 200, and the short side edge of the parallel side edges, such as side edge 216 of the locking tab aperture 152, defined in the body of the tongue. The non-parallel side edges of the aperture, such as side edges 218 and 220 of the aperture 152, slide against the arcuate edge of the locking tab ears during insertion of the tab into the locking tab aperture in a manner known in the art. As is also shown in FIG. 1, side edges, such as side edge 206 of the tongue 34, are separated from the side edges of the wall panels, such as side edge 66 of the wall panel 52, by slits which remove little or no material from the blank so the blank can be appropriately folded without undue inteference between the two adjacent edges.

The tongues 38 and 40 are trapezoidal in shape and have lengths which differ from each other. The tongue 38 is adapted to engage wall panel 76 and the tongue 40 is adapted to engage wall panel 78. As will be noted in FIG. 1, the wall panels 76 and 78, are foldably attached to end panel 24, and hence no locking tabs are located adjacent the tongues 38 and 40 in a manner as to require notches, such as notch 204. Likewise tongue 44 does not have a notch, nor is it adjacent a wall panel as are the other tongues, (with the exception of tongues 38 and 40) but is otherwise similar in shape and operation to the other tongues.

As shown in FIG. 1, every flap is connected at one end thereof to one end of a wall panel, and has a width less than that of the corresponding wall panel so that a shoulder is defined at the foldline which defines the common end edge between each flap and the corresponding wall panel. For example, flap 72 has shoulders 226 and 228 defined adjacent the foldline defining end edge 60 of the wall panel 52 and end edge 230 of the flap 72. The reduced width of each of the flaps permits the flaps to be easily positioned adjacent, and inside (as referenced to a formed container), the corresponding tongues while leaving sufficient clearance space for the appropriate locking tabs to be inserted through the locking tab receiving apertures in those tongues to thereby lock the appropriate wall panel to the tongues in a position whereat it will be reinforced and supported by the flaps. Such clearance space, or gap, is clearly shown between end edge 94 of flap 76 and side edge 231 of flap 120, and is identified by the reference numeral 232. The gap 232 is equal to, or greater than the thickness of the locking tabs, such as locking tabs 134 and 135, so that the tabs can be locked into locking tab receiving apertures 154 and 155 to lock the wall panel 76 to the end panel 22 with flaps 72 and 120 in a position to reinforce the wall panel 76. As will be later discussed, the reinforced wall panel 76 can be used as a base upon which the container is supported.

As is also shown in FIG. 1, the side edges of the end panels intersect to form a plurality of corners 250 through 276, and the wall panels and flaps each have corners which are defined by the intersection of the side edges and end edges thereof to correspond to the corners of the end panels. The corners of the wall panels and flaps are denoted by reference numerals which correspond to the reference numerals identifying the end panel corners, and are numbered so that corners of the wall panels and flaps and corresponding corners of the end panels are given the same reference numbers with the wall panels and flaps having an identifying suffix thereon. Thus, for example, corner 250 of the end panel 22 corresponds to corner 250*a* of the first wall panel 12, and to corner 250*b* of the second wall panel 50, and so forth. The first wall panel is denoted by the suffix *a*, the second wall panel is denoted by the suffix *b*, and so forth, and the flaps are denoted by the suffix *i*. Likewise, adhesive receiving flange 160 has corners 256*j* and 258*j* which correspond to corners 256 and 258 of the end panel 22.

The end edges of the tongues and side panels intersect corresponding end edges of adjacent tongues and wall panels at, or near, the corners of the end panels to form a plurality of notchlike openings, such as notchlike opening 280 defined adjacent the corner 254 by end edge 208 of tongue 34 and end edge 282 of the tongue 38, so that the flaps, tongues and wall panels can be folded about the foldlines to form a container without interferring with each other.

Set-up and formation of the container is quickly and easily accomplished, and is illustrated in FIGS. 2 through 5. Thus, after an item such as an automobile air filter, is placed on an end panel, such as end panel 24, the blank panels are oriented into the position shown in FIG. 2, by folding the blank 10 along the foldlines defining side edges 14 and 16 of the first wall panel 12 until that panel is upright, i.e., 90°, with respect to the end panels 22 and 24, which panels are in substantial parallelism with each other, then folding tongues 32 and 42, as well as tongues 30 and 44, and flange 160 at the foldlines defining the side edges thereof, folding wall panel 80 upwardly from the FIG. 1 orientation (i.e., out of the plane of the paper), and adhesively securing panel 80 to the flange 160. From the orientation shown in FIG. 2, the tongue 40 is folded downward, e.g., 90°, into an orientation which is essentially perpendicular to the end panel 22, and locking tabs 130, 131, 137 and 138 are folded inwardly, i.e., 90°, with respect to the corresponding wall panels to be inserted into the corresponding locking tab receiving apertures 150, 151, 157 and 158 as wall panels 50 and 110 are being foldably moved into position as shown by arrows 300 and 302 in FIG. 2. Flaps 70 and 122 are then folded about the end edges thereof as shown by arrows 304 and 306 so that these flaps assume a position in back of tongue 40 to be trapped behind tongue 40 (i.e., inside a completed container) when that wall panel is folded upwardly with respect to end panel 24 as shown by arrow 308. The flaps, such as flaps 70 and 122, reinforce the walls of the container, thus allowing a plurality of containers to be stacked on top of each other. The locking tab 136 can be folded into the position shown in FIGS. 2 and 3, and then inserted into locking tab receiving apertures 156 as the wall panel 78 is folded upwardly with respect to end panel 24 to form a side wall of the container.

Figure 4:
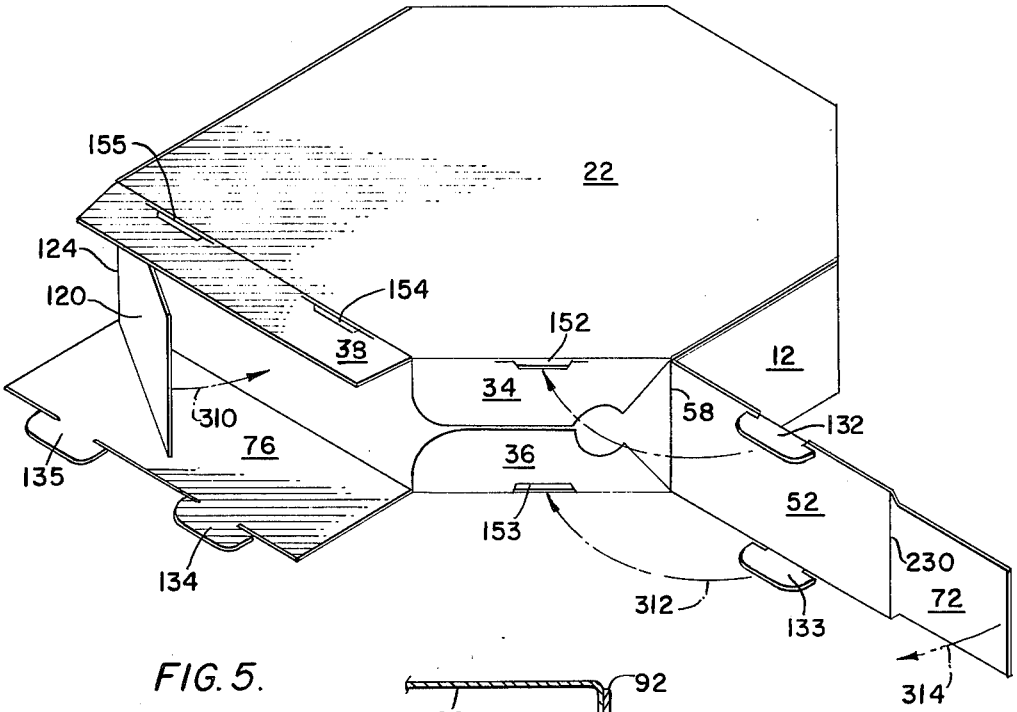
Figure 5:
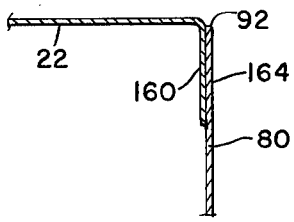
FIG. 5 is a sectional elevation view along line 5—5 of FIG. 3.
Figure 6:
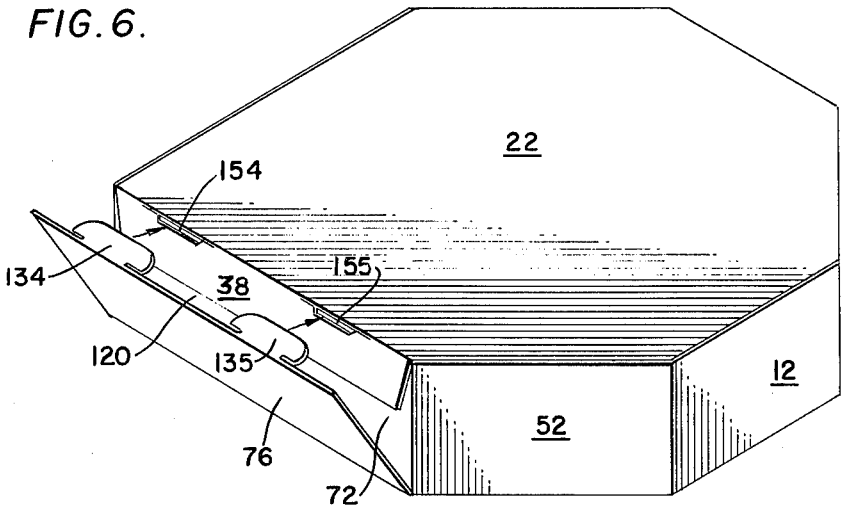
FIG. 6 is a perspective view of a partially formed container in accordance with the teachings of the present invention.

A similar process is performed on the wall panels 52 and 76 to complete the container, as shown in FIGS. 4 and 6. Thus, after the partially set-up container is in the FIG. 3 orientation, locking tabs 132 and 133 are folded into the FIG. 3 position, flap 120 folded inwardly about the end edge 124 thereof as shown by arrow 310 into a position adjacent tongue 28, and on the inside thereof (as referenced according to a completed container), and wall panel 52 is folded about the end edge 58 thereof, as illustrated by arrow 312, so that locking tabs 132 and 133 are received in locking tab apertures 152 and 153, respectively. The flap 72 is folded about end edge 230 thereof to be adjacent tongue 38 and on the inside thereof (with respect to a completed container).

As shown in FIG. 6, locking tabs 135 and 136 are appropriately folded, and tongue 28 is folded downwardly with respect to the FIG. 4 position into the FIG. 6 position to be adjacent the flaps 72 and 120.

The container is completed by folding wall panel 76 upwardly from the FIG. 4 position so that locking tabs 134 and 135 are received in apertures 154 and 155, respectively, and tongue 38 is trapped between the wall panel 76 and the flaps 72 and 120.

Thus, long wall panels of the completed container are formed by wall panels 76 and 80, and these side wall panels are securely supported by the flaps 72, 120 and flange 160, respectively, and held in position by the adhesive, such as the glue 164 and the tabs 134 and 135 respectively. The wall panel 76 has two locking tabs thereon, and the wall panel 80 is adhesively secured, preferably throughout its length, to the end panel 22 via flange 160.

Because of the angular orientation, the reinforcing flaps, the integral connections, and the placement and orientation of the locking tabs, a container formed from blank 10 is very stable and has a high resistance to crushing or deformation. Thus, the container can be stacked using any of the wall panels, but preferably the wall panels formed from panels 76 and 80, as a base upon which the container rests. Other similar containers can be stacked on, or next to, the just-discussed container in a neat, compact and stable array because of the polygonal shape of the containers. The flat wall panels are conducive of such compact and stable arrangements.

Of course, any folding procedure can be used, such as one wherein tongue 40 is located behind (i.e., inside the container) flaps 70 and/or 122 and wall 78, and/or tongue 38 is located behind (i.e., inside the container) flaps 72 and/or 120. Furthermore, any suitable adhesive means, such as glue, heat sealing adhesive, or the like, can be used without departing from the teachings of the present invention.

The wall panels 76 and 80 are illustrated as being adjacent each other and oriented to form an essentially right angle at corner 270. These two adjacent wall panels are of the same length, but can also be of unequal lengths, and each have a length greater than the length of any of the other wall panels. It is also noted that wall panel 76 has two locking tabs thereon, i.e., locking tabs 134 and 135, and is thus securely held in position, and the wall panel 80 is securely held in position by adhesive means, such as glue 164 and flange 160.

Because of the position and shape of the wall panels 76 and 80, as well as the secure nature of their connection to the first end 22, either, or both, of these wall panels can be used as a base upon which the container can rest. Thus, a multiplicity of containers, either filled or unfilled, can be stacked in a secure and stable manner next to each other, on top of each other, or the like. The reinforced and securely attached wall panels, and especially wall panels 76 and 80, enable the container to be thus stacked without collapsing.

Furthermore, because of the plurality of wall panel lengths, especially the lengths of wall panels 76 and 80 which differ from the lengths of the other wall panels, the container can be oriented in a large variety of positions. For example, wall panel 76 can be used as a base upon which the container rests, or wall panel 80 can be used as a base. The polygonal shape of the container enables it to be easily stacked or stored adjacent other polygonal containers. Thus, if a multiplicity of containers are to be stacked, stored, shipped, or the like, they can be handled in a minimum amount of space, or in a manner which coacts with the associated display, and still represent a stable and secuure array. Such containers are amenable to being displayed in a manner so that they coact with the display structure.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or that form their functional as well as conjointly cooperative equivalents, are therefore intended to be embraced by those claims.

What is claimed is:

1. An integral foldable container blank, comprising:

a first rectangular wall panel;

a first polygonal end panel foldably connected along one edge thereof to one side edge of said first wall panel, said end panel having an adhesive receiving flange foldably attached to another edge thereof, and a plurality of tongues foldably connected to the other edges thereof, said tongues having locking tab receiving apertures defined therein;

a second polygonal end panel foldably connected along one edge thereof to the other side edge of said first wall panel, and having a plurality of tongues foldably connected thereto at other edges thereof;

second and third rectangular wall panels each having a flap foldably connected to an end edge thereof and each connected along the other end edge thereof to an end edge of said first wall panel;

fourth and fifth rectangular wall panels each foldably connected along one side edge thereof to an edge of said second end panel, said fourth and fifth wall panels having locking tabs on the other side edges thereof;

a sixth rectangular wall panel foldably connected along one side edge thereof to an edge of said second end panel and having a flap foldably connected to one end edge thereof;

a seventh rectangular wall panel foldably connected along one end edge thereof to the other end edge of said sixth wall panel and including locking tabs on each side edge thereof and a flap on the other end edge thereof;

two of said wall panels being adjacent each other and each having a length greater than the length of the other wall panels.

2. An integral foldable container forming blank, comprising:

a plurality of rectangular wall panels, some of which are foldably attached together at the ends thereof;

a pair of polygonal end panels each foldably attached along an edge thereof to a side edge of one wall panel of said plurality of said wall panels;

a plurality of tongues each foldably attached to edges of each of said end panels and each having a locking tab receiving aperture defined therein;

a plurality of locking tabs each foldably attached to a side edge of each of said wall panels and adapted to be received in a corresponding locking tab receiving aperture to close the container;

an adhesive receiving flange foldably attached to one edge of a first end panel of said pair of end panels;

the second end panel of said pair of end panels having several wall panels of said plurality of wall panels foldably attached at the side edges thereof to edges of said second end panel, with a pair of said several wall panels having lengths greater than the remaining wall panels of said plurality of wall panels for forming wall panels upon which a formed container can be supported; and a plurality of flaps each foldably attached to ends of said wall panels to be adjacent other wall panels to reinforce said other wall panels in the formed container.

3. The blank of claim 1 wherein said end panels are irregular heptagons.

4. The blank of claim 1 wherein the width of each of the flaps is less than the width of the wall panels to which said flap is connected to define shoulders on said flaps.

5. The blank of claim 1 wherein one wall panel of the wall panels connected to said second end panel has a plurality of locking tabs thereon.

6. The blank of claim 1 wherein said tongues are irregular trapezoids each having a curved corner.

7. The blank of claim 1 wherein said fourth and sixth wall panels have lengths which are greater than the lengths of the other wall panels.

8. The blank of claim 1 wherein said fourth and sixth wall panels are adjacent each other.

9. A container comprising:

a first rectangular wall panel;

a first polygonal end foldably attached along one edge thereof to one side edge of said first wall panel and having a plurality of tongues with locking tab receiving apertures defined therein foldably attached to other edges thereof, and an adhesive receiving flange foldably connected to another edge thereof;

a second polygonal end foldably attached along one edge thereof to the other side edge of said first wall panel and having a plurality of tongues with locking tab receiving apertures defined therein foldably attached to other edges thereof;

a pair of rectangular wall panels each foldably attached to one end edge to an end edge of said first wall panel, each of said pair of wall panels including a flap foldably connected thereto along the other end edge thereof and a locking tab foldably connected to each side edge thereof and locked in one of said locking tab receiving apertures;

fourth, fifth and sixth rectangular wall panels each foldably connected along a side edge thereof to an edge of said second end, with said fourth and fifth wall panels having a locking tab foldably connected to the other side edge and locked in a corresponding locking tab receiving aperture to lock said wall panels to said ends via said locking tab receiving apertures in said tongues with said flaps engaged against said wall panels;

a seventh rectangular wall panel foldably connected along one edge thereof to an end edge of said sixth wall panel and having a flap foldably connected to the other end edge thereof, and engaged against said fifth wall panel;

said sixth wall panel having a flap foldably connected to the other end edge thereof and engaged against said fourth wall panel, said sixth wall panel being attached to said adhesive receiving flange on said first end to close the container;

two wall panels being adjacent each other and each having a length greater than the length of other wall panels.

10. A container comprising:

a plurality of rectangular wall panels, some of which are foldably attached together at the ends thereof and a pair of which wall panels are longer than the each of the other wall panels;

a pair of polygonal ends each foldably attached along one edge thereof to a side edge of one wall panel;

a plurality of locking tabs each foldably attached to a side edge of each of said wall panels;

a plurality of tongues each foldably attached to edges of each of said ends and to said wall panels by said locking tongues being engaged in apertures defined in said tongues;

an adhesive receiving flange foldably attached to one edge of a first end and adhesively secured to one of said wall panels;

a plurality of flaps foldably attached at their ends to said ends and located inside the container adjacent walls to reinforce said wall panels;

said pair of wall panels being reinforced and adapted to support the container in an upright position.

11. The container of claim 9 wherein said two adjacent wall panels form an essentially right angle with each other.

12. The container of claim 9 wherein said two adjacent wall panels are of lengths equal to each other.

13. The container of claim 9 wherein said two adjacent wall panels are comprised of said fourth and sixth wall panels.

14. The container of claim 9 wherein said ends are in the shape of irregular heptagons.

15. The container of claim 2 wherein said fourth and sixth wall panels are said two wall panels.

* * * * *